US005421445A

United States Patent [19]

Alvarez Mata et al.

[11] Patent Number: 5,421,445

[45] Date of Patent: Jun. 6, 1995

[54] COIN LOCK FOR BAR OF SUPERMARKET CART

[76] Inventors: Evelio Alvarez Mata; Victor Del Blanco Alvarez, both of Poligono Los Frailes 5, 28814 Daganzo de Arriba, Spain

[21] Appl. No.: 177,165

[22] Filed: Jan. 4, 1994

[51] Int. Cl.[6] ..... G07F 5/02; G07F 17/00

[52] U.S. Cl. ..... 194/253; 194/257; 194/905

[58] Field of Search ..... 194/205, 212, 247, 253, 194/257, 259, 905

[56] References Cited

U.S. PATENT DOCUMENTS

| | | | |
|---|---|---|---|
| 4,637,507 | 1/1987 | Ricouard et al. | 194/212 |
| 4,924,994 | 5/1990 | Pinsson et al. | 194/253 |
| 4,941,560 | 7/1990 | Bailey | 194/905 X |
| 5,040,656 | 8/1991 | DiPaolo et al. | 194/257 X |
| 5,180,045 | 1/1993 | Sonnendorfer et al. | 194/212 |

FOREIGN PATENT DOCUMENTS

| | | | |
|---|---|---|---|
| 2662284 | 11/1991 | France | 194/905 |
| 3841003 | 6/1990 | Germany | 194/905 |

*Primary Examiner*—Michael S. Huppert
*Assistant Examiner*—Scott L. Lowe

[57] ABSTRACT

A coin lock for carts in which the body of the lock is provided with two levers which turn upon introduction of a coin and displace lock plates which release a closure locking plate by which the lock is held to an adjacent element. The levers are held in a closure locking plate release position by means of bars which swing in a vertical plane around individual pins and then engage and hold the levers apart and hold the levers and the lock plates in their releasing positions. Upon its introduction the closure locking plate acts against the elastic action of individual springs and presses against and turns the bars downward. This releases the levers and turns them, under the elastic action of individual springs, into the releasing position. This in turn frees the coin for removal.

13 Claims, 2 Drawing Sheets

COIN LOCK FOR BAR OF SUPERMARKET CART

BACKGROUND OF THE INVENTION

The present invention relates to a coin lock for stowed articles, particularly articles with a clampable part, such as a bar. The invention is particularly applicable to supermarket carts, or the like.

Various types of locks of this type are known, for example, for stowing supermarket carts. Most of these locks have a plastic housing, which can easily be deformed. Further, the system of attachment to the handlebar of the cart does not provide great security. Also, the mechanism of the lock is complicated with respect to the number of its parts and their relationship, so that present locks are not very competitive. These and other characteristics cause present locks to present problems both in manufacture and in use.

SUMMARY OF THE INVENTION

In order to overcome the drawbacks of the prior art, a coin lock has been devised for stowing an article with a clampable part, like a bar, e.g. a supermarket cart. The lock of the invention has the following advantages over known locks. The part which blocks and frees the closure hook or closure locking plate of the lock, as well as the parts on which the hook or closure locking plate itself slides, the coins and the rods are all seated on surfaces of minimum contact, and they are provided with depressions which decrease the friction.

The lock housing, cover and clamps are made of aluminum. The mechanism is simple and does not require skilled labor to make it.

The lock is secured to the handlebar of the cart by two part circular clamping shells or parts. Each clamping part includes a pointed protrusion, and the protrusions clamp on the surface of the handlebar of the cart to prevent rotation of the lock on the bar. In order to remove the coin collector or detach it, it is necessary to remove the clamping parts. The attachment of a chain to the lock is effected by a pin.

According to the invention, the coin lock for stowing supermarket carts is formed from a prismatic block shaped body having a lateral offset around its perimeter on which the closure cover fits and is fastened by screws. The block has a chain, which is attached by a pin to the block. At its free end, the chain carries the coupling and closure locking plate of the lock. On its upper face, the block has a series of recesses and offsets to position two swing levers which are urged into a lock activated position at all times by the elastic action of individual springs. Each swing lever engages in a respective lock plate which is guided in a respective channel for laterally inward and outward motion as the levers swing.

Each swing lever has in the region of its rotation axis a curved edge profile, so that when a coin is introduced through a lateral opening in the block, the coin swings the levers around their respective pivots, which displaces the lock plates laterally. This turned position of the two levers is fixed by two respective bars which are swingable in the direction perpendicular to the plane of the lock plates. The bars each have straight end offsets which fasten the swing levers in their separated apart positions where the levers are turned by the insertion of the coin. The bars are swung under the action of two springs.

Opposite the opening into the block where the coin is introduced, the block has another opening into which the closure locking plate, e.g. from an adjacent cart, is introduced. This attaches the two carts together. Upon being introduced into the respective lateral opening, the closure locking plate moves the two lock plates toward the outside, which thereby turn the levers toward the outside. The levers remain positioned separated apart by the turning of the respective bars under spring action.

The closure locking plate is secured in the lock body by the lock plates and is freed when those plates are moved outward. The closure locking plate, in turn, presses against a facing end spring, which normally pushes the closure locking plate out of its opening when the lock plates free it to so move.

In order more easily to understand the shape and construction of the coin lock of the invention, a practical embodiment is shown below which is merely illustrative and is not limiting.

Other objects and features of the present invention will become apparent from the following description of the invention which refers to the accompanying drawings.

DETAILED DESCRIPTION OF THE INVENTION

Figure 1:
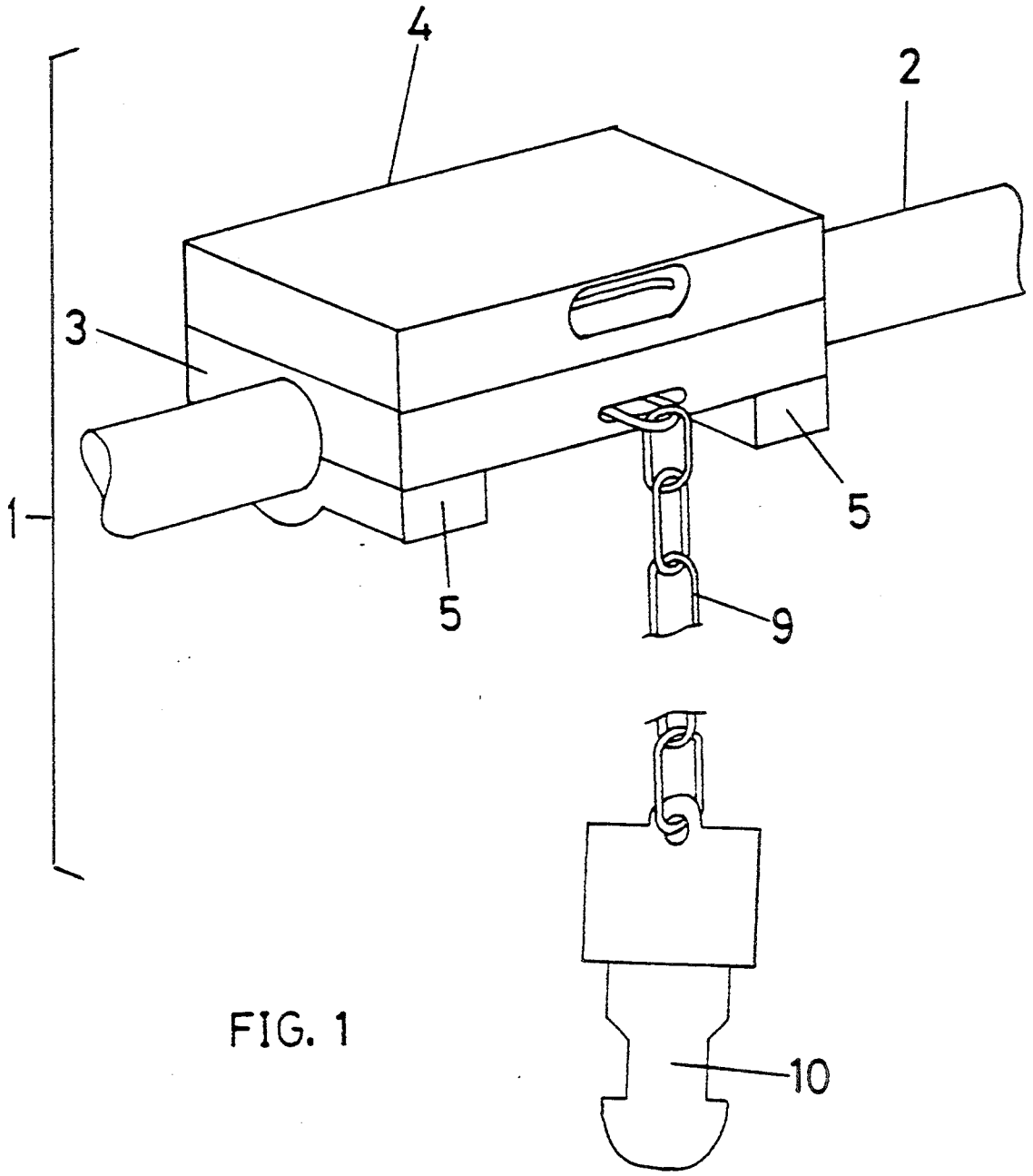
FIG. 1 is a perspective view of the coin lock of the invention.

Referring to the drawings, the coin lock 1 of the invention may be fastened to the handlebar 2 of a supermarket cart (not shown). It may also be clamped to other clampable objects. The lock 1 is formed of a body or block 3 and a cover 4 over the open side of the body. The block 3 has an offset 8 on its perimeter which facilitates the attachment of the cover 4 on the block.

Figure 3:
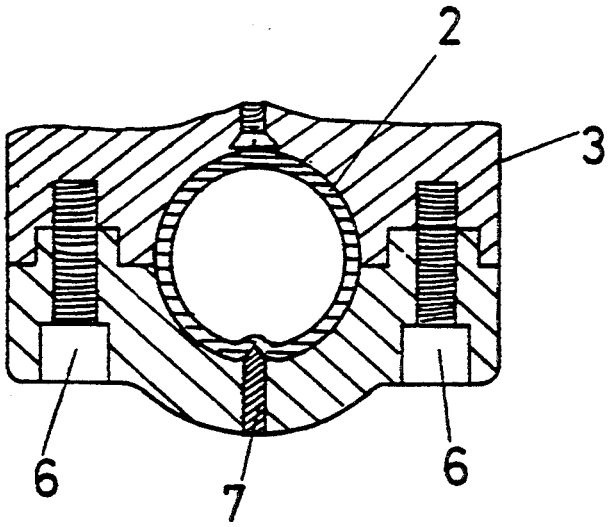
FIG. 3 is a sectional view through the coupling of the coin lock to a handlebar of a supermarket cart.

Two clamps 5 are attached on the block to mount the lock on the cart by means of screws 6, or the like attachment means. The clamps 5 have a pointed protrusion 7 which presses into the handlebar, as seen in FIG. 3. The lock is intended to remain secured on the handlebar.

A chain 9 is fastened on the block. A closure lock plate 10 is firmly secured to the free end of the chain.

Figure 2:
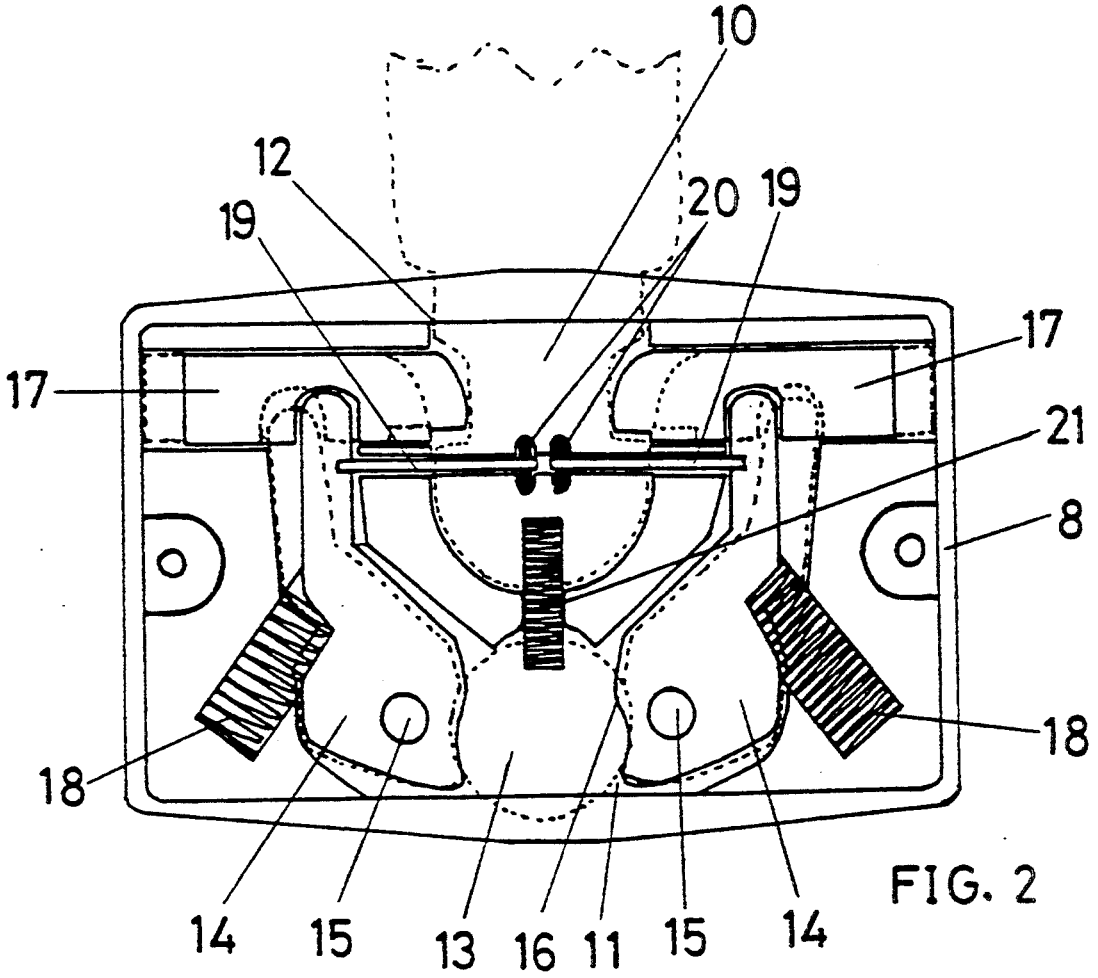
FIG. 2 is a view of the two positions of actuation of the lock of FIG. 1.

FIG. 2 shows the mechanism of the coin lock in two positions. The position of rest is indicated in solid line and the position of actuation in dashed line.

The block 3 has two oppositely facing lateral openings 11 and 12. A coin 13 is introduced into one opening 11. This causes both swing levers 14 to swing around their pivot pins 15 when the coin presses against the curved edge profiles 16 at the opposing sides of the levers. The curved edge profiles 16 are shaped first such that the insertion of a coin swings the arms of the levers 14 outward and secondly such that with those arms swung outward, the levers hold the inserted coin so as to prevent its removal from the opening 11. This swinging of the levers 14 displaces separate, flat, lock plates 17 toward both outside lateral sides of the block and against the action of the springs 18 which oppose swinging of the levers 14.

There are bars 19 which are swingably mounted on respective pins 20 located generally centrally between the levers 14. The bars 19 swing perpendicularly to the swing path of the levers 14 and perpendicularly to the direction of extension and movement of the lock plates 17. Springs at the pins 20 normally urge the bars 19 down toward the levers 14. When the levers 14 have been separated by an inserted coin 13, the bars 19 swing down between the levers to hold them apart and thereby to hold the lock plates 17 apart to free the central closure locking plate 10 for removal from its opening 12 in the block 3.

The closure locking plate 10, which is now freed from previous restraint by the lock plates 17, is expelled from the opening 12 by the action of the compression spring 21, which at its other side may be pressed upon by the inserted coin 13. This releases the chain 9 from the neighboring lock and, for example, frees the cart for its use. Reinsertion of the closure locking plate 10 raises the bars 19 against the spring force on them so that when the enlarged head of that plate 10 has passed the lock plates 17 and when the coin 13 is extracted, the levers 14 swing back to their rest position under the influence of their springs 18, and the lock plates 17 return to their positions locked into the recessed neck of the closure locking plate 10.

When the cart is returned, in order to recover the coin, the central closure locking plate 10 is introduced into its opening again. This turns the levers 14 in the direction which frees the coin.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A coin operated lock securable to a clampable object, comprising:

a lock body with a cover closing the body;

the lock body having a first opening for receiving a closure locking plate and a second opening spaced from the first opening for receiving a closure locking plate releasing coin;

a closure locking plate receivable in the first opening for being secured there and released upon introduction of a coin into the second opening;

a swing lever supported for swinging in the body, the swing lever having a profiled edge placed within the body to be engaged by a coin which is introduced into the second opening in the body;

a displaceable lock plate seperate from the swing lever in the body having an engaging position at which it engages and holds to the closure locking plate and having a releasing position at which it releases the closure locking plate for extraction from the first opening in the body and also at which it permits introduction of the closure locking plate into the first opening of the body, a slot provided on the lock plate;

a part of the swing lever engaging the slot in the lock plate so that upon swinging of the swing lever between engaging and releasing positions thereof, the lock plate is moved between the respective engaging and releasing positions thereof; the swing lever and the lock plate therewith engaged being so positioned and movable with respect to the closure locking plate that upon a coin contacting and swinging the swing lever, the swing lever moves the lock plate to the releasing position;

a swingable bar swingably mounted to the body of the lock and having a part which is remote from the swingable mount thereof and which is engageable with the lever for holding the lever in the releasing position, and the bar being swingable transversely to the lever so as to move off the lever and permit the lever to move to the engaging position with the coin removed from the second opening;

the bar being so positioned and swingable that upon introduction of the closure locking plate into the first opening of the block, the closure locking plate presses on the bar and moves the bar to a position permitting the swing lever to swing to the engaging position, and such swinging movement of the swing lever also permit release of the coin from the second opening in the block; and means on the lock body for being clamped to another object.

2. The lock of claim 1, wherein the bar has an end part for engaging the lever and clamping the lever in the releasing position.

3. The lock of claim 1, further comprising a spring normally urging the swing lever and the lock plate to the engaging position, whereby a coin inserted into the second opening in the block swings the lever against the bias of the spring therefor.

4. The lock of claim 1, wherein the clamping means comprise means in the block fastenable to a bar, and including clamp elements engageable with the bar, the clamp elements including a point of protrusion intended for pressing into the bar for preventing the lock from turning.

5. The lock of claim 1, further comprising means connecting the closure locking plate with the body such that the closure locking plate may be inserted into and removed from the body, and when removed from the body, the closure locking plate will nonetheless remain connected with the body.

6. A coin operated lock securable to a clampable object, comprising:

a lock body with a cover closing the body;

the lock body having a first opening for receiving a closure locking plate and a second opening spaced from the first opening for receiving a closure locking plate releasing coin;

a closure locking plate receivable in the first opening for being secured there and released upon introduction of a coin into the second opening;

a pair of swing levers supported in the body for swinging in opposite directions with respect to each other, the swing levers having respective profiled edges placed within the body to be engaged by a coin which is introduced into the second opening in the body, the profiled edges including corresponding engageable surfaces which are opposable toward each other for being engaged by a coin disposed between those surfaces;

a respective displaceable lock plate in the body for each of the levers, each lock plate having an engaging position at which it engages and holds to the closure locking plate and having a releasing position at which it releases the closure locking plate for extraction from the first opening in the body and also at which it permits introduction of the closure locking plate into the first opening of the body;

the swing levers engaging the corresponding lock plates so that upon swinging of the swing levers between engaging and releasing positions thereof, the lock plates are moved between the respective engaging and releasing positions thereof; the swing levers and the lock plates therewith engaged being so positioned and movable with respect to the closure locking plate that upon a coin contacting and swinging the swing levers, the swing levers move the lock plates to the releasing positions;

a respective swingable bar for each of the swing levers, each swingable bar swingably mounted to the body of the lock and having an end part which is remote from the swingable mount thereof and which is structured and arranged for engaging the lever and clamping the lever in the releasing position, and the bar being swingable transversely to the corresponding lever so as to move off the lever and permit the lever to move to the engaging position with the coin removed from the second opening;

the bars being so positioned and swingable that upon introduction of the closure locking plate into the first opening of the block, the closure locking plate presses on the bars and moves the bars to respective positions permitting the swing levers to swing to the engaging positions, and such swinging movements of the swing levers also permits release of the coin from the second opening in the block;

means on the lock body for being clamped to another object.

7. A coin operated lock securable to a clampable object, comprising:

a lock body with a cover closing the body;

the lock body having a first opening for receiving a closure locking plate and a second opening spaced from the first opening for receiving a closure locking plate releasing coin;

a closure locking plate receivable in the first opening for being secured there and released upon introduction of a coin into the second opening;

a pair of swing levers supported in the body for swinging in opposite directions with respect to each other, the swing levers having respective profiled edges placed within the body to be engaged by a coin which is introduced into the second opening in the body, the profiled edges including corresponding engageable surfaces which are opposable toward each other for being engaged by a coin disposed between those surfaces;

a respective displaceable lock plate in the body for each of the swing levers, each lock plate having an engaging position at which it engages and holds to the closure locking plate and having a releasing position at which it releases the closure locking plate for extraction from the first opening in the body and also at which it permits introduction of the closure locking plate into the first opening of the body;

the swing levers engaging the corresponding lock plates so that upon swinging of the swing levers between engaging and releasing positions thereof, the corresponding lock plates are moved between the respective engaging and releasing positions thereof; the swing levers and the lock plates therewith engaged being so positioned and movable with respect to the closure locking plate that upon a coin contacting and swinging the swing levers, the swing levers move the lock plates to the releasing positions;

a respective swingable bar for each of the swing levers, each swingable bar being swingably mounted to the body of the lock and having a part which is remote from the swingable mount thereof and which is engageable with the corresponding lever for holding the lever in the releasing position, and the bar being swingable transversely to the corresponding lever so as to move off the lever and permit the lever to move to the engaging position with the coin removed from the second opening;

the bars being so positioned and swingable that upon introduction of the closure locking plate into the first opening of the block, the closure locking plate presses on the bars and moves the bars to respective positions permitting the swing levers to swing to the engaging positions, and such swinging movements of the swing levers also permits release of the coin from the second opening in the block; and means on the lock body for being clamped to another object.

8. The lock of claim 7, further comprising a respective spring normally urging each of the swing levers and the lock plates to the engaging position, whereby a coin inserted into the second opening in the block swings the levers against the bias of the respective springs therefor.

9. The lock of claim 7, wherein the block body has opposite sides and the first and second openings being on respective opposite sides of the block body.

10. The lock of claim 7, further comprising a spring communicating between the region in the body of the lock in which a coin is received through the second opening and the region of the body in which the closure locking plate is received, such that upon insertion of a coin through the second opening, the spring is engaged by the coin, and the spring in turn presses on the closure locking plate for urging the closure locking plate out of the first opening in the body when the levers are moved to the releasing position.

11. The lock of claim 7, wherein the clamping means comprise means in the block fastenable to a bar, and including clamp elements engageable with the bar, the clamp elements including a point of protrusion intended for pressing into the bar for preventing the lock from turning.

12. The lock of claim 11, wherein the clamping means comprise a first bar engaging clamp element in the body and a second bar engaging clamp element in the cover; and means securing the cover to the body for also clamping the clamp element on the bar.

13. A coin operated lock securable to a clampable object, comprising:

a lock body with a cover closing the body;

the lock body having a first opening for receiving a closure locking plate and a second opening spaced from the first opening for receiving a closure locking plate releasing coin;

a closure locking plate receivable in the first opening for being secured there and released upon introduction of a coin into the second opening;

a swing lever supported for swinging in the body, the swing lever having a profiled edge placed within the body to be engaged by a coin which is introduced into the second opening in the body;

a displaceable lock plate in the body having an engaging position at which it engages and holds to the closure locking plate and having a releasing position at which it releases the closure locking plate for extraction from the first opening in the body and also at which it permits introduction of the closure locking plate into the first opening of the body;

the swing lever engaging the lock plate so that upon swinging of the swing lever between engaging and releasing positions thereof, the lock plate is moved between the respective engaging and releasing positions thereof; the swing lever and the lock plate therewith engaged being so positioned and movable with respect to the closure locking plate that upon a coin contacting and swinging the swing lever, the swing lever moves the lock plate to the releasing position;

a swingable bar swingably mounted to the body of the lock and having a part which is remote from the swingable mount thereof and which is engageable with the lever for holding the lever in the releasing position, and the bar being swingable transversely to the lever so as to move off the lever and permit the lever to move to the engaging position with the coin removed from the second opening;

the bar being so positioned and swingable that upon introduction of the closure locking plate into the first opening of the block, the closure locking plate presses on the bar and moves the bar to a position permitting the swing lever to swing to the engaging position, and such swinging movement of the swing lever also permits release of the coin from the second opening in the block;

means on the lock body for being clamped to another object;

a spring communicating between the region in the body of the lock in which a coin is received through the second opening and the region of the body in which the closure locking plate is received, such that upon insertion of a coin through the second opening, the spring is engaged by the coin, and the spring in turn presses on the closure locking plate for urging the closure locking plate out of the first opening in the body when the lever is moved to the releasing position.

* * * * *